United States Patent [19]

Hasegawa et al.

[11] 4,055,430

[45] Oct. 25, 1977

[54] LIGHT SENSITIVE MATERIAL CONTAINING AN ETHYLENE COMPOUND DYE FORMER, AN ORGANIC POLYMER COMPOUND CONTAINING CHLORINE AND A PLASTICIZER

[75] Inventors: Eiichi Hasegawa; Kenichiro Yazawa, both of Asaka, Japan

[73] Assignee: Fuji Photo Film Co., Ltd., Minami-ashigara, Japan

[21] Appl. No.: 687,127

[22] Filed: May 17, 1976

[30] Foreign Application Priority Data

May 15, 1975 Japan ..... 50-58281

[51] Int. Cl.[2] ..... G03C 1/52

[52] U.S. Cl. ..... 96/90 R; 96/115 P

[58] Field of Search ..... 96/90 R, 115 P

[56] References Cited

U.S. PATENT DOCUMENTS

| | | | |
|---|---|---|---|
| 3,042,516 | 7/1962 | Wainer | 96/90 R |
| 3,510,304 | 5/1970 | Fichter et al. | 96/90 R |
| 3,533,792 | 10/1970 | Petro et al. | 96/90 R |
| 3,907,569 | 9/1975 | Hazy et al. | 96/90 R |

*Primary Examiner*—Won H. Louie, Jr.

*Attorney, Agent, or Firm*—Sughrue, Rothwell, Mion, Zinn and Macpeak

[57] ABSTRACT

An image-wise light-sensitive composition containing (a) an organic polymer compound containing chlorine; (b) a coloring matter forming compound represented by the formula:

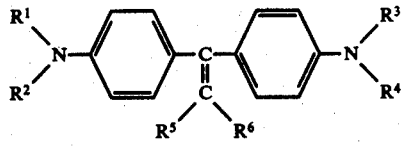

wherein $R^1$ through $R^4$ each represent a hydrogen atom, an alkyl group, or an aryl group, and $R^5$ to $R^6$ each present a hydrogen atom, an alkyl group, or $R^5$ and $R^6$ can combine with each other to form a 5- or 6-membered carbon ring, and (c) a liquid capable of dissolving said organic polymer compound and coloring matter-forming compound.

10 Claims, No Drawings

LIGHT SENSITIVE MATERIAL CONTAINING AN ETHYLENE COMPOUND DYE FORMER, AN ORGANIC POLYMER COMPOUND CONTAINING CHLORINE AND A PLASTICIZER

BACKGROUND OF THE INVENTION

1. Field of the Invention

The present invention relates to image-forming light-sensitive compositions, more particularly, to image-forming light-sensitive compositions containing the combination of an organic polymer compound containing chlorine and a coloring matter-forming compound.

2. Description of the Prior Art

Hitherto, image-forming light-sensitive compositions produced using organic compounds containing a halogen atom or atoms and light-sensitive materials produced using these image-forming light-sensitive compositions have been known.

For instance, British Pat. No. 1,247,506 uses compounds represented by the formula: A—C—$X_3$, wherein A is alkyl, aryl, aralkyl, or aroyl, or chlorine, bromine, or iodine, and X is chlorine, bromine, or iodine, as the halogen atom containing organic compound. Japanese Patent Application (Laid Open) No. 11056/1973 (U.S. Ser. No. 154,609, filed June 18, 1971) uses compounds in which at least three halogen atoms other than fluorine are connected to one carbon atom. Iodoform is listed as a representative example of the halogen atom containing organic compounds. Iodoform, however, has a noxious odor at normal conditions and is highly toxic. Thus, image-forming compositions using iodoform and light-sensitive materials using such image-forming compositions suffer from the disadvantages in that their odor is marked and they are toxic.

In the above patents, polystyrene or polycarbonate is used as an organic polymeric binder, but there is no disclosure concerning the effect of these polymer compounds on image formation by printing-out.

As a result of the inventors' research on light-sensitive compositions for use in image formation by printing-out, which are odor-free and non-toxic, have excellent quality, and are produced from raw materials which are commercially available with ease and are stable, it has been found that the combination of an organic polymer compound containing chlorine and a coloring matter-forming compound unexpectedly provide light-sensitive compositions capable of providing colored images of high senstivity and sharpness, and which are free from defects such as toxicity, bad odor, etc.

SUMMARY OF THE INVENTION

One object of the present invention is to provide light-sensitive compositions for use in image formation by printing-out in which an image is obtained only by an image-wise exposure where additional developing processings are not necessary.

Another object of the present invention is to provide light-sensitive compositions for use in image formation by printing-out in which no organic material having toxicity or generating unpleasant odors is used.

A further object of the present invention is to provide light-sensitive compositions for use in image formation by printing-out which are of high sensitivity and high image density.

Still another object of the present invention is to provide light-sensitive compositions for use in image formation by printing-out which can be produced with ease.

Another object of the present invention is to provide light-sensitive materials produced from compositions satisfying the above objects.

These objects are attained by the combination of:

a. an organic polymer compound containing chlorine;

b. a coloring matter-forming compound represented by the formula:

(1)

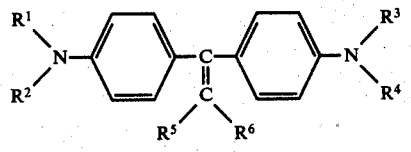

wherein $R^1$ through $R^4$ each represent a hydrogen atom, an alkyl group of 1 to 6 carbon atoms which can be substituted with a hydroxy group end the like (e.g., a methyl, ethyl, propyl, butyl, pentyl, isopropyl, isopentyl, hexyl, hydroxymethyl, 2-hydroxyethyl group, etc.), or an aryl group which can be substituted (e.g., a phenyl, phenethyl, p-tolyl group, etc.), and $R^5$ to $R^6$ each represent a hydrogen atom, an alkyl group of 1 to 6 carbon atoms), e.g., a methyl, ethyl, propyl, butyl, pentyl, hexyl group, etc., or $R^5$ and $R^6$ can combine with each other to form a 5- or 6-membered carbon ring; and c. a liquid capable of dissolving (a) and (b).

DETAILED DESCRIPTION OF THE INVENTION

The present invention provides a light-sensitive composition for use in image formation by printing-out which comprises (a) an organic polymer compound containing chlorine, (b) a coloring matter-forming compound represented by the above formula, and (c) a liquid capable of dissolving (a) and (b).

Chlorine containing organic polymer compounds used in the present invention include: (1) polymers or copolymers of compounds containing at least one chlorine-carbon bond and, at the same time, one or two ethylenically unsaturated bonds; (2) compounds produced by chlorinating or sulfochlorinating polymers or copolymers of compounds containing one or two ethylemicallyunsaturated bonds, or by modifying them chemically with epichlorohydrin or chlorohydrin; and (3) compounds produced by chlorinating acid cellulose derivatives containing a carboxylic acid substituent or substituents as side chains, e.g., carboxymethyl cellulose, having 0.9 to 2.4, preferably 1.5 to 2.4, substituents per one glucose unit on the average, wherein the substitution degree of the cellulose is about 0.3 to about 0.8, preferably 0.5 to 0.8.

Of these organic polymer compounds, those having a chlorine content of about 20 to about 80% by weight, especially 50 to 70% by weight, are preferred. Also, those having an average degree of polymerization of about 50 to about 3,000, particularly 100 to 400, are preferred.

Representative examples of the above polymers or copolymers (1) are: chlorine-containing homopolymers such as polyvinyl chloride, polyvinylidene chloride, polychloroprene, and the like; co- or ter-polymers of vinyl chloride and other monomers such as a vinyl chloride-ethylene copolymer, a vinyl chloride-butadiene copolymer, a vinyl chloride-vinylidene chloride copolymer, a vinyl chloride-vinyl ether copolymer, a vinyl chloride-vinyl ester (e.g., vinyl actate, vinyl butyrate, chlorovinyl acetate, vinyl caprate, vinyl stearate, and the like) copolymer, a vinyl chloride-acrylate (preferably an ester of a 1 to 10 carbon atom alkanol and acrylic acid, e.g., methyl acrylate, ethyl acrylate, or the like) copolymer, a vinyl chloride-methacrylate (preferably an ester of a 1 to 10 carbon atom alkanol and methyacrylic acid, e.g., methyl methacrylate, ethyl methacrylate, or the like) copolymer, a vinyl chloride-acrylic acid copolymer, a vinyl chloride-methacrylic acid copolymer, a vinyl chloride-acrylonitrile copolymer, a vinyl chloride-methacrylonitrile copolymer, a vinyl chloride-maleate (preferably an ester of a 1 to 10 carbon atom alkanol and maleic acid, but not, of course, limited thereto, e.g., dimethyl maleate, diethyl maleate, diphenyl maleate, or the like) copolymer, a vinyl chloride-maleic acid copolymer, a vinyl chloride-ethylene-vinyl acetate copolymer, a vinyl chloride-ethylene-acrylate (preferably an ester with a 1 to 10 carbon atom alkanol, e.g., methyl acrylate, ethyl acrylate, or the like) copolymer, a vinyl chloride-ethylene-ethylene sulfonic acid chloride copolymer, and the like; and other copolymers such as a vinylidene chloride-acrylonitrile copolymer, a $\beta$-chlorostyrene-styrene copolymer, and the like.

Representative examples of the above compounds (2) are: chlorinated polyolefins (most preferably based upon an olefin having 2 to 4 carbon atoms, e.g., polyethylene, polypropylene, an ethylene-propylene copolymer, polybutylene, polyisobutylene and the like), chlorinated polystyrene, partially chlorinated compounds of styrene copolymers (e.g., a styrene-ethylene copolymer, a styrene-acrylonitrile copolymer, and the like), partially chlorinated polyacrylic acid, partially chlorinated polyacrylates (e.g., polymethyl acrylate, polyethyl acrylate, and the like), partially chlorinated copolymers of acrylic acid e.g., an acrylic acid-ethylene copolymer and the like), partially chlorinated acrylate copolymers (e.g., an ethyl acrylate-ethylene copolymer and the like), partially chlorinated itaconic acid copolymers, partially chlorinated crotonic acid copolymers, partially chlorinated maleic acid copolymers, partially chlorinated maleic acid monoesters (e.g., methyl maleate, ethyl maleate, or the like), chlorosulfonated polyolefins (e.g., polyethylene, polypropylene, an ethylene-propylene copolymer, or the like), and chlorinated rubbers (e.g., natural rubber, polyisoprene, or the like), etc. For any copolymers in the representative examples of the above compounds (2), preferred comonomers are olefins having from 2 to 4 carbon atoms.

The above compounds can be used singly or in combination with each other. Moreover, they can be used in combination with other various resins such as thermoplastic resins, thermosetting resins and the like. In this case, however, it is desired that these resins be added in such a manner that the chlorine content falls within the above described chlorine content range. In this case, the thermoplastic resin and the thermosetting resin are most preferably added, when used, in an amount of about 1 to about 5 weight % of the above described organic polymer, respectively.

While not to be construed as limitative, typical examples of useful thermoplastic resins include polyvinyl butyral, polyvinylformal, polyvinyl pyrrolidone, cellulose triacetate, cellulose diacetate, cellulose acetate butyrate, ethyl cellulose, etc., and typical examples of thermosetting resins include phenol-formaldehyde resins, urea-formaldehyde resin, ureamelamine resins, etc.

In the image-forming light-sensitive compositions of the present invention and the light-sensitive materials carrying a layer containing the above light-sensitive composition, the chlorine-containing organic polymer compound acts as a binder for the composition, and, at the same time, when used in combination with the color dye-forming compound, undergoes a coloring reaction due to light sensitivity and photochemical reaction, although the mechanism of the color development reaction due to light sensitivity and photochemical reaction is not clear.

As liquids for use in the image-forming light-sensitive compositions of the present invention, those liquid plasticizers for polymers which are liquid at room temperature (15° to 35° C) can be used with success in the present invention.

Representative examples of these liquids are: (1) phthalic acid esters such as dibutyl phthalate, dioctyl phthalate, bis-2-ethylhexyl phthalate, dimethyl phthalate, butyllauryl phthalate, dilauryl phthalate, butylbenzyl phthalate, and the like; (2) straight chain dibasic acid esters such as dioctyl adipate, diisooctyl azelate, dioctyl sebacate, and the like; (3) phosphoric acid esters such as tricresyl phosphate, trixylenyl phosphate, monooctyldiphenyl phosphate, monobutyldixylenyl phosphate, trioctyl phosphate, and the like; (4) castor oil derivatives such as methyl acetylricinolate, butyl acetylricinolate, methyl cellosolve ricinolate, and the like; (5) epoxides of unsaturated aliphatic acids (e.g., oleic acid, elaidic acid, erucic acid, linolic acid, linolenic acid, and the like) which are produced by hydrolysis from soybean oil, sesame oil, rape seed oil, and cotton seed oil; (6) tri-or tetraethyleneglycol esters of $C_6$–$C_{10}$ aliphatic acids, such as butyl phthalylbutyl glycolate and the like; (7) polyester based plasticizers such as an adipic acid-propylene glycol ester polymers, an adipic acid-1,3-butylene glycol ester polymer, and the like, having an average molecular weight of about 1,000 to about 3,000; (8) citric acid esters such as tributyl citrate, acetyltributyl citrate, triethyl citrate, acetyltriethyl citrate, acetylbis-2-ethylhexyl citrate, and the like; (9) glycidyl ethers such as glycerol glycidyl ether, polyethyleneglycol diglycidyl ether, trimethylolpropane glycidyl ether, and the like; (10) glycols and polyhydric alcohol esters of acrylic and methacrylic acids, such as ethylene glycol dimethacrylic acid ester, diethylene glycol dimethacrylic acid ester triethylene glycol dimethacrylic acid ester, nonaethylene glycol dimethacrylic acid ester, tetradecaethylene glycol dimethacrylic acid ester, trimethylolpropane acrylic acid ester, trimethylolpropane methacrylic acid ester, trimethylolpropane triacrylic acid ester, trimethylolpropane trimethyacrylic acid ester, pentaerythritol acrylic acid ester, pentaerythritol methacrylic acid ester, pentaerythritol trimethacrylic acid ester, pentaerythritol triacrylic acid ester, and the like; and (11) chlorinated paraffin hydrocarbons such as those mainly comprising n-paraffins having 16 to 40 carbon atoms and having a chlorine content of 30 wt% to 45 wt%; etc. These liquids can be used alone or in combination with each other.

The liquids are mutually soluble with the chlorine-containing organic polymer compounds, improve the flexibility of the finished light-sensitive material, i.e., increase flexibility, and increase the solubilities of components contained in the image-forming composition of the present invention. Furthermore, they can suitably change the color density and hue of the finally obtained image depending upon the combination thereof with the chlorine-containing organic polymer compound.

Representative examples of the coloring matter-forming compunds represented by the above formula are: 1,1-bis(p-aminophenyl)ethylene, 1,1-bis(p-methylaminophenyl)ethylene, 1,1-bis(p-dimethylaminophenyl)ethylene (m.p. 123° C), 1,1-bis-(p-ethylaminophenyl)ethylene, 1,1-bis(p-diethylaminophenyl) ethylene, 1,1-bis(p-aminophenyl)-1-propene, 1,1-bis(p-methylaminophenyl)-1-propene, 1,1-bis(p-dimethylaminophenyl)-1-propene, 1,1-bis(p-ethylaminophenyl)-1-propene, 1,1-bis(p-diethylaminophenyl)-1-propene, 1,1-bis(p-aminophenyl)-2-methyl-1-propene, 1,1-bis(p-methylaminophenyl)-2-methyl-1-propene, 1,1-bis(p-dimethylaminophenyl)-2-methyl-1-propene (m.p. 66°-67° C), 1,1-bis-(p-ethylaminophenyl)-2-methyl-1-propene, 1,1-bis(p-diethylaminophenyl)-2-methyl-1-propene, [bis(p-methylaminophenyl)methylene]cyclopentane, [bis(p-dimethylaminophenyl)methylene]cyclopentane (m.p. 118°-120° C), [bis(p-ethylaminophenyl)-methylene]cyclopentane, [bis(p-diethylaminophenyl)-methylene]cyclopentane, 1,1-bis[p(hydroxymethyl-)aminophenyl]ethylene, 1,1-bis]p-di(hydroxymethyl-)aminophenyl]ethylene, 1,1-bis[p-(β-hydroxyethyl-)aminophenyl]ethylene, 1,1-bis[p-di(β-hydroxyethyl-)aminophenyl]ethylene, 1,1-bis[p-(hydroxymethyl-)aminophenyl]-2-methyl-1-propene, 1,1-bis-[p-di(hydroxymethyl)aminophenyl]-2-methyl-1-propene, 1,1-bis-[p-di(β-hydroxyethyl)aminophenyl]-2-methyl-1-propene, 1,1-bis-[p-(phenylamino)phenyl]ethylene, 1,1-bis[p-(phenylamino)phenyl]-1-propene, 1,1-bis[p-(phenylamino)phenyl]-2-methyl-1-propene, {bis[p-(phenylamino)phenyl]methylene}cyclopentane, 1,1-bis[-p-(diphenylamino)phenyl]ethylene, 1,1-bis[p-diphenylamino)phenyl]-1-propene, [bis(p-aminophenyl)methylene]cyclohexane, [bis(p-methylaminophenyl)methylene]cyclohexane, [bis(p-dimethylaminophenyl)methylene]cyclohexane (m.p. 145°-147° C), [bis(p-ethylaminophenyl)methylene]cyclohexane, [bis(p-diethylaminophenyl)methylene]cyclohexane, and the like.

These compounds can be synthesized by the methods described in *Justus Liebigs Annalen der Chemie,* Vol. 461, page 152, or a modification thereof.

With regard to the proportion of (a) the chlorine-containing organic polymer compound, (b) the coloring matter-forming compound represented by the above formula, and (c) the liquid in the image-forming light-sensitive composition of the present invention, the chlorine-containing organic polymer compund (a) is about 10% to about 90%, preferably 40% to 70%, the coloring matter-forming compound represented by the above formula (b) is about 0.01% to about 10%, preferably 0.1% to 1%, and the fluid liquid (c) is about 5% to about 70%, preferably 40% to 60%, each percent being by weight based on the total weight of the composition.

The image-forming light-sensitive composition of the present invention can be used as a solution or dispersion thereof, which can be handled with ease, by adding a solvent thereto in producing the composition or in coating the composition on a support. In producing the solution or dispersion, various organic solvents which do not deteriorate the characteristics of the image-forming light-sensitive composition of the present invention can be used. Organic solvents which can be used in the present invention include alcohols such as methanol, ethanol, isopropanol, n-propanol, and the like; ethers such as dimethyl ether, diethyl ether, methyl ethyl ether, dioxane, tetrahydrofuran, and the like; ethylene glycol monoethers such as methyl cellosolve, ethyl cellosolve, cellosolve acetate, and the like; ketones such as acetone, methyl ethyl ketone, diethyl ketone, and the like; aromatic hydrocarbons such as benzene, toluene, xylene, and the like, chlorinated hydrocarbons such as chlorobenzene, methylene chloride, ethylene chloride, trichloroethylene, 1,1,1-trichloroethane, and the like.

These organic solvents can be used singly or in combination with each other. In producing the solution or dispersion of the image-forming light-sensitive composition of the present invention in the above solvent, the solvent is added in such a manner that the composition comprises about 10% to about 70% by weight, preferably 30% to 50% by weight, of the total weight of the dispersion or solution.

To the image-forming light-sensitive composition, or the solution or dispersion thereof, can be added well known additives such as photopolymerization initiators, heat-polymerization inhibitors, coloring matter, and the like which do not deteriorate the properties of the composition.

The image-forming light-sensitive composition of the present invention can be provided on a support as it is or as a solution or dispersion thereof. In the case that the composition is prepared as a solution or dispersion thereof, the solution or dispersion is uniformly coated on a support by methods conventionally used, and the solvent is then evaporated by known methods (hereinafter referred to as "drying"), thereby resulting in the formation of the composition on the support.

As known methods useful to coat the solution or dispersion of the image-forming light-sensitive composition of the present invention, any of blade coating, spray coating, rotary coating, rod coating, dip coating, curtain coating and like coating methods can be used.

The image-forming light-sensitive composition of the present invention is coated on the support so as to provide a layer thickness of about 1 μm to about 100 μm, preferably 4 μm to 40 μm. Where the composition is coated on the support as a solution or dispersion thereof, the term "layer thickness" designates the thickness of the layer after drying, i.e., after the organic solvent is evaporated and removed. On the other hand, where the image-forming light-sensitive composition of the present invention is coated on the support as it is without using any solvent, the term means the thickness of the layer in providing the composition on the support in layer form.

Light-sensitive materials produced by providing the solution or dispersion of the image-forming light-sensitive composition of the present invention on the support are dried by conventional methods. Temperatures at which the drying is effected range between about 15° C and about 100° C, preferably 40° C and 80° C. In effecting the drying, it is possible to blow a gas such as air or an inert gas, e.g., nitrogen, neon, argon, helium or the like thereon (this procedure is especially useful when one is preparing a light-sensitive material for use in intergrated circuit formation) at the same time to remove the solvent vapor, thereby accelerating drying. Also, it is possible to dry the layer of the light-sensitive composition using infrared rays of the wavelength region at which the composition is substantially insensitive. Where the temperature of the drying is above about 100° C, the chlorine-containing organic polymer compound begins to decompose, resulting in the decomposition of the image-forming light-sensitive composition. On the other hand, where the temperature is below about 15° C, the time required for the drying is extremely long, which is preactically unusable.

Representative examples of supports on which the image-forming light-sensitive composition of the present invention can be provided, include wood, glass (e.g., silicate glass, soda-lime glass, borosilicate glass, barium galss, and the like), ceramics (e.g., hard porcelain, soft porcelain, aluminous porcelain, titanium porcelain, beryllia porcelain, mullite porcelain, talc porcelain, spinel porcelain, zircon porcelain, ferrite porcelain, earthenware, glazed earthenware, and the like), cermets, quartz, monocrystalline silicon, sapphire, metals (e.g., iron, copper, zinc, antimony, nickel, cobalt, aluminum, titanium, chromium, tungusten, molybdenum, gold, platinum, palladium, iridium, rhodium, ruthenium, zirconium, tantalum, hafnium, and the like), alloys (iron alloys, aluminum alloys, copper alloys, magnesium alloys, nickel alloys, and the like), enamels, metals and alloys with ceramics coated on the surface thereof, metals and alloys with an oxide layer on the surface thereof, plastics (e.g., cellulose nitrate, cellulose acetate, cellulose acetate butyrate, cellulose acetate propionate, polystyrene, polyethylene terephthalate, polycarbonate, polyethylene, polypropylene, an ethylene-butene copolymer, epoxy resins, poly(pyromellitic acid-p-phenylenediamineimide) resins, poly(p-hydroxybenzoate) resins, poly(ethylene-2,6-naphthalate)resins, and the like), paper, cloth, carbon fibers, other carbon materials, etc.

In general, the above material is used in the form of a thin plate or film, but other desired forms can be used depending upon the purpose and use. Furthermore, it is possible to use supports which are produced by combining one material selected from the above with another material, or laminating or coating one material on another material. Where it is desired that the adhesion between the image-forming light-sensitive composition and the surface of the support be strengthened, preliminary processings such as coarsening of the surface of the support (sand graining, chemical etching, and the like), corona dicharge, ultraviolet ray irradiation, flame treatment, etc., can be applied.

The image-forming light-sensitive composition and the light-sensitive material produced from this image-forming light-sensitive composition provide sharp images upon the application of image-wise exposure using active rays, for example, near ultraviolet rays having a wavelength of 290 nm to 400 nm, visible rays having a wavelength of 400 nm to 740 nm, electron beams, etc.

The image-forming light-sensitive composition of the present invention can be used in photographic films, laser recording materials, printing plates, materials for chemical dosimetry, etc.

The present invention is illustrated in more detail by the following Comparison Example and Examples.

COMPARISON EXAMPLE (Comparison Example to Example 1)

Into a mixed solution of 20 ml of toluene and 20 ml of methyl ethyl ketone was dissolved 10 g of chlorinated polyethylene powder (Superchlon CPE-907 LTA, produced by Sanyo-Kokusaku Pulp Co., Ltd.; chlorine content, not less than 66% by weight, M.W. 17,000 ± 3,000 measured by gel permeation chromatography), and then 0.4 g of 1,1-bis(p-dimethylaminophenyl)ethylene was added thereto. The resulting mixture was stirred for 3 hours to produce a solution of an image-forming light-sensitive composition.

This solution was uniformly coated on a 25 μm thick polyethylene terephthalate film to a dry thickness of about 10 μm and dried at 80° C for 10 minutes to produce a light-sensitive material. Onto the light-sensitive layer of the light-sensitive material there was placed a transparent negative, which was then subjected to image-wise exposure with a ultra-high pressure mercury lamp (produced by ORC Seisakusho; 2 KW) at a distance of 55 cm for 1 minute. No image was obtained.

EXAMPLE 1

Into a mixed solution of 20 ml of toluene and 20 ml of methyl ethyl ketone was dissolved 10 g of chlorinated polyethylene powder (the same as used in Comparison Example), and then 13 g of pentaerythritol methacrylic acid ester and 0.4 g of 1,1-bis(p-dimethylaminophenyl-)ethylene were added thereto. The resulting mixture was mixed to produce a solution of an image-forming light-sensitive composition.

This solution was coated in the same manner as in the Comparison Example to produce a light-sensitive material. Upon subjecting the light-sensitive material to image-wise exposure through the transparent negative in the same manner as in the Comparison Example, a blue, sharp positive was obtained as a duplicate of the negative.

Light-sensitive materials, which were produced as described above and were not used, were allowed to stand in the dark at room temperature (which changed within the range of 18° C to 25° C) over a period of one month and two months. Thereafter, on subjecting the light-sensitive materials to image-wise exposure through the transparent negative as in the Comparison Example, the same sharp blue positive as was obtained with the fresh light-sensitive material was obtained.

EXAMPLE 2

The same solution of the image-forming light-sensitive composition as was used in Example 1 was coated on an aluminum plate of a thickness of 200 μm to produce a light-sensitive material. Upon subjecting this light-sensitive material to image-wise exposure through the transparent negative in the same manner as in the Comparison Example, the same sharp blue positive as was obtained in Example 1 was obtained.

EXAMPLE 3

To the image-forming light-sensitive composition used in the Comparison Example there was added trimethylolpropane trimethacrylic acid ester as the liquid component. The resulting mixture was coated on supports of polyethylene terephthalate and aluminum as in Examples 1 and 2 to produce light-sensitive materials. Upon subjecting these light-sensitive materials to image-wise exposure through a transparent negative having sharp contrast in the same manner as in the Comparison Example, a pale green positive was obtained.

EXAMPLE 4

Into a mixed solution of 40 ml of toluene and 20 ml of methyl ethyl ketone was dissovled 15 g of chlorinated polyethylene (the same as was used in Comparison Example), and then 0.53 g of 1,1-bis(p-dimethylaminophenyl)ethylene and 13 g of nonaethylene glycol dinethacrylic acid ester were added thereto to produce a solution of an image-forming light-sensitive composition. This solution was coated to a dry thickness of 5 μm on a 25 μm thick polyethylene terephthalate film and then dried at 80° C for 10 minutes to produce a light-sensitive material.

Upon irradiating this light-sensitive material with a 2 KW ulta-high pressure mercury lamp at a distance of 55 cm for 3 minutes, a dark brown image developed.

EXAMPLES 5, 6, and 7

The procedure of Example 1 was repeated except that the compounds shown in Table 1 were used as the chlorine-containing polymer compounds.

Upon image-wise exposure on the image-forming light-sensitive composition layer of each light-sensitive material, the colors shown in Table 1 developed.

Table 1

| Ex. | Chlorine-containing Polymer Compound | Color |
|---|---|---|
| 5 | Chlorinated polypropylene*1 | Blue |
| 6 | Chlorosulfonated polyethylene*2 | Blue |
| 7 | Vinyl chloride-vinyl acetate copolymer*3 | Pale Blue |

*1Chlorinated polypropylene
Superchlon CPP-306 produced by Sanyo-Kokusaku Pulp Co., Ltd. Chlorine content, not less than 66% (by weight) molecular weight 15,000 ± 5,000, measured by gel permeation chromatography
*2Chlorosulfonated polyethylene
Hypalon-30; Mooney Viscosity (ML-4) 30; specific gravity 1.28 produced by E.I. Dupont Co. Chlorine content, 43% (by weight)
*3Vinyl chloride-vinyl acetate copolymer
Denka Lac 11H produced by Electro Chemical Industry Co., Ltd. vinyl chloride: vinyl acetate = 70:30 (by weight);Chlorine content, 42% (by weight); degree of polymerization of about 100; viscosity of about 4,000 –6,000 cps. measured as a 65 wt. % solution of Denka Lac 11H in a solvent of 20 parts by weight of trichloroethylene and 20 parts by weight of toluene.

EXAMPLES 8 and 9

The procedure of Example 1 was repeated except that the compounds shown in Table 2 were used as the coloring matter-forming compounds.

The image-forming light-sensitive composition layer of each light-sensitive material developed color as shown in Table 2.

Table 2

| Ex. | Coloring Matter-forming Compound | Color |
|---|---|---|
| 8 | [bis(p-dimethylaminophenyl)methylene]-cyclopentane | Blue |
| 9 | 1,1-bis(p-dimethylaminophenyl)-2-methyl-1-propene | Pale Blue |

EXAMPLE 10

Into a mixed solution of 20 ml of toluene and 20 ml of methyl ethyl ketone was dissolved 10 g of chlorinated polyethylene powder (the same as was used in the Comparison Example), and then 10 g of pentaerythritol trimethacrylic acid ester, 3 g of pentaerythritol tetramethacrylate, 0.5 g of glycerol diglicidyl ether, 0.65 g of 2-methyl anthraquinone, 0.2 g of Aerosil (noncrystalline silicon oxide powder produced by Degussa), and 0.3 g of 1,1-bis(p-diaminophenyl)ethylene were added thereto. The resulting mixture was mixed to produce a solution of an image-forming light-sensitive composition.

This solution was coated to a dry thickness of 15 μm on a 25 μm thick polyethylene terephthalate film and dried at 80° C for 10 minutes to produce a light-sensitive material.

Onto the image-forming light-sensitive composition layer of the light-sensitive material there was placed a transparent negative, which was then subjected to image-wise exposure through a negative with a 2 KW ultra-high pressure mercury lamp at a distance of 55 cm for 1 minute. A sharp blue positive image was obtained as a duplicate of the negative.

EXAMPLE 11

A solution of an image-forming light-sensitive composition was prepared in the same manner as in Example 10. This solution was uniformly coated on a 200 μm thick aluminum plate [the surface of which was subjected to anodic oxidation after sand graining] to a dry thickness of 5 μm and then dried to produce a light-sensitive material. Onto the image-forming light-sensitive composition layer of this light-sensitive material then was placed a dot negative, which was then image-wise exposed through the negative with a 2 KW ultra-high pressure mercury lamp at a distance of 55 cm for one minute to thereby obtain a positive image.

Thereafter, the layer carrying this positive image was treated with a mixed solution of n-propanol and ethylene chloride (3:10 volume) at 20° C for 1 minute to thereby leave the positive image areas and remove the image-forming light-sensitive composition at the other areas, whereby an offset printing plate was obtained. With this printing plate, 2,000 sharp copies were obtained by a conventional offset printing method.

While the invention has been described in detail and with reference to specific embodiments thereof, it will be apparent to one skilled in the art that various changes and modifications can be made therein without departing from the spirit and scope thereof.

What is claimed is:

1. An image-forming light-sensitive composition consisting essentially of (a) an organic polymer compound containing chlorine, (b) a coloring matter-forming compound represented by the formula:

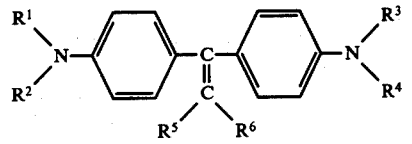

wherein $R^1$ through $R^4$ each represent a hydrogen atom, a lower alkyl group, or an aryl group, and $R^5$ to $R^6$ each represents a hydrogen atom, a lower alkyl group, or $R^5$ and $R^6$ combine with each other to form a 5- or 6-membered carbocyclic ring, and a plasticizing amount of a liquid plasticizer selected from the group consisting of a phthalic acid ester, a straight chain dibasic acid ester, a phosphoric acid ester, a ricinolate derived from castor oil, an epoxide, of an unsaturated aliphate acid a tri- or tetraethylene glycol ester of a $C_6$ to $C_{10}$ aliphatic acid, a polyester based plasticizer, a citric acid ester, a glycidyl ether, a glycol or polyhydric alcohol ester of acylic or methacrylic acid or a chlorinated paraffin hydrocarbon for said organic polymer containing chlorine and capable of dissolving the coloring matter-forming compound.

2. The image-forming light-sensitive composition according to claim 1, wherein the organic polymer compound containing chlorine is selected from the group consisting of chlorine-containing homopolymers, copolymers or terpolymers of vinyl chloride.

3. The image-forming light-sensitive composition according to claim 1, wherein the organic polymer compound is selected from the group consisting of chlorinated polyolefin, chlorinated polystyrene, partially chlorinated styrene copolymers, partially chlorinated polyacrylic acid, partially chlorinated polyacrylates, partially chlorinated acrylic acid polymers, partially chlorinated acrylate copolymers, partially chlorinated itaconic acid copolymers, partially chlorinated crotonic acid copolymers, partially chlorinated maleic acid copolymers, partially chlorinated maleic acid monoesters, chlorosulfonated polyolefin, and chlorinated rubbers.

4. The image-forming light-sensitive composition according to claim 1, wherein the proportion of the chlorine-containing organic polymer compound is about 10 to about 90% by weight, based on the total weight of the composition.

5. The image-forming light-sensitive composition according to claim 4, wherein the proportion of the coloring matter-forming compound is about 0.01 to about 10% by weight, based on the total weight of the composition.

6. The image-forming light-sensitive composition according to claim 5, wherein the proportion of the liquid is about 5 to about 70% by weight, based on the total weight of the composition.

7. A light-sensitive material comprising a support and a coating thereon of the image-forming light-sensitive composition of claim 1.

8. The image-forming light-sensitive composition according to claim 1, wherein the liquid plasticizer is liquid at temperature of 15° to 35° C.

9. The image-forming light-sensitive composition according to claim 1, wherein said alkyl groups for $R^1$ through $R^4$ and $R^5$ to $R^6$ are alkyl groups of 1 to 6 carbon atoms.

10. The image-forming light-sensitive composition according to claim 1, wherein for said liquid plasticizer, i. said phthalate acid ester is selected from the group consisting of dibutyl phthalate, dioctyl phthalate, bis-2-ethylhexyl phthalate, dimethyl phthalate, butyllauryl phthalate, dilauryl phthalate or butylbenzyl phthalate;

ii. said straight chain dibasic acid ester is selected from the group consisting of dioctyl adipate, diisooctyl azelate or dioctyl sebacate;

iii. said phosphoric acid ester is selected from the group consisting of tricresyl phosphate, trixylenyl phosphate, monooctyldiphenyl phosphate, monobutyldixylenyl phosphate or trioctyl phosphate;

iv. said ricinolate derived from castor oil is selected from the group consisting of methyl acetylricinolate, butyl acetylricinolate or methyl cellosolve ricinolate;

v. said epoxide of an unsaturated aliphatic acid produced by hydrolysis of an oil selected from the group consisting of soybean oil, sesame oil, rape seed oil or cotton seed oil;

vi. said tri-or tetraethyleneglycol ester of a $C_6$ to $C_{10}$ aliphatic acid is butyl phthalylbutyl glycolate;

vii. said polyester based plasticizer is an adipic acid-propylene glycol ester polymer or an adipic acid-1, 3-butylene glycol ester polymer, each having an average molecular weight of about 1,000 to about 3,000;

viii. said citric acid ester is selected from the group consisting of tributyl citrate, acetyltributyl citrate, triethyl citrate, acetyltriethyl citrate or acetylbis-2-ethylhexyl citrate;

ix. said glycidyl ether is selected from the group consisting of glycerol glycidyl ether, polyethyleneglycol diglycidyl ether or trimethylolpropane glycidyl ether;

x. said glycol or polyhydric alcohol ester of acrylic or methacrylic acid is selected from the group consisting of ethylene glycol dimethacrylic acid ester, diethylene glycol dimethacrylic acid ester, triethylene glycol dimethacrylic acid ester, nonaethylene glycol dimethacrylic acid ester, tetradecaethylene glycol dimethacrylic acid ester, trimethylolproprane acrylic acid ester, trimethylolpropane methacrylic acid ester, trimethylolpropane triacrylic acid ester, trimethylolpropane trimethacrylic acid ester, pentaerythritol acrylic acid ester, pentaerythritol methacrylic acid ester, pentaerythritol trimethacrylic acid ester or pentaerythritol triacrylic acid ester; and xi. said chlorinated paraffin hydrocarbon comprises n-paraffins having 16 to 20 carbon atoms and a chlorine content of 30 to 45 weight percent.

* * * * *